United States Patent [19]

Marten

[11] 4,299,103

[45] Nov. 10, 1981

[54] ROLLING MILL

[75] Inventor: Hans-Friedrich Marten, Kreuztal, Fed. Rep. of Germany

[73] Assignee: Schloemann-Siemag Akt., Düsseldorf, Fed. Rep. of Germany

[21] Appl. No.: 16,098

[22] Filed: Feb. 28, 1979

[30] Foreign Application Priority Data

Mar. 2, 1978 [DE] Fed. Rep. of Germany ..... 280888

[51] Int. Cl.[3] ..... B21B 37/02; B21B 1/28

[52] U.S. Cl. ..... 72/16; 72/205; 72/161; 72/249

[58] Field of Search ..... 72/8–11, 72/16, 249, 205, 199, 161, 234

[56] References Cited

U.S. PATENT DOCUMENTS

| | | | |
|---|---|---|---|
| 2,287,380 | 6/1942 | Klein et al. | 72/234 X |
| 3,253,445 | 5/1966 | Franek | 72/205 X |
| 3,823,593 | 7/1974 | Yydrin et al. | 72/234 |
| 4,145,901 | 3/1979 | Imai et al. | 72/8 |

*Primary Examiner*—Milton S. Mehr

*Attorney, Agent, or Firm*—Norman S. Blodgett; Gerry A. Blodgett

[57] ABSTRACT

A method of and apparatus for rolling metal strips in a rolling mill having a 4-high roll stand and a tension roll stand comprising a plurality of pairs of combined rollers. The method comprises advancing the metal strips through the 4-high roll stand and tension roll stand, so that the strip extends between the roller of each pair of combined rollers and is partially wrapped around each of the rollers. The rollers of each pair are rotated in opposite directions at a pre-determined circumferential differential speed ratio.

14 Claims, 8 Drawing Figures

ROLLING MILL

BACKGROUND OF THE INVENTION

The invention concerns itself with a procedure for the rolling of metal strips in roll stands having pairs of combined rolls. The rolls of each pair are driven in opposite directions and at different circumferential speeds. The metal strip surrounds each roll over at least part of its circumference. The thickness of the metal strip is reduced by creation of various shear stresses in the various material cross-section zones which produces traverse sliding of the crystals.

In this procedure, "traverse-sliding" describes an action in which a form change takes place by which the crystals of the rolling stock are only deformed by thrust forces acting parallel to the slide area in the sliding direction, in the absence of which a twist of the slide area occurs. This "traverse-sliding" is the result of the different circumferential speeds of the roll pairs driven against each other in opposite directions, creating a shear stress, that is, an elastic stress which originates in outer forces acting in the cross-section area of the rolling stock.

With this type of rolling procedure, we are concerned with a traverse-sliding or a thrust-rolling procedure. The invention is also concerned with a rolling mill for execution of this procedure which can be designated in a manner corresponding to the previously-described definitions as a traverse-sliding, resp. thrust rolling mill. Rolling procedures and rolling mills of this type are described in German patent publications DE-OS No. 19 40 265 and DE-AS No. 21 33 058.

During a rolling operation with the conventional rolling mill, two material sliding zones are formed, namely a pre-stretch zone and a compression zone, on the contact areas between each roll and the rolling stock. The frictional forces within the zones are directed against each other. Such a slide zone formation between the rolling stock and the working rolls is prevented by the traverse-sliding, thrust rolling procedure. The advantage which results is that the rolling operation may be executed by preventing the high starting forces that are required in the common rolling procedures.

In the actual operating experience with the device made known through publication DE-OS No. 19 40 265, supra, of the newly-designed control of the thickness of the rolled stock have developed. To solve these problems, automatic thickness control has been tried. However, in every case shortcomings were experienced in efforts to achieve optimum rolling results, in spite of the technical expenditures. Therefore, it has been suggested in the publication DE-AS No. 21 33 058, supra, to create a rolling device of the same type which is distinguished by the fact that each of the combined working rolls is driven by its own motor. The roll, having a higher circumferential speed, is driven at a constant speed which is independent of the necessary load, whereas, with a roll having a lesser circumferential speed, the loading applied is selected in a reverse ratio. Consequently, therefore, the ratio of the circumferential speed of the combined working rolls corresponds to the ratio of the thickness of the rolling stock at its entrance and exit section.

This method eliminates the need for expensive and complicated automatic thickness controls. However, since each individual roller must be equipped with its own drive motor and its own variable gear, the expenditure is considerable. If a rolling device is equipped with a number of rolls, the installation of many motors and variable gear arrangements present spacing difficulties.

The principle object of the present invention is to eliminate the problems experienced with German patent publications DE-OS No. 19 40 265 and DE-AS No. 21 33 058, supra, by providing a procedure and a rolling mill of the same type in which a thickness control is completely eliminated from all traverse-sliding, or thrust rolling zones.

Another object of this invention is the provision of a method in which the final thickness control for the rolling stock is made by maintaining a pre-determined circumferential speed differential ratio between the individual rollers of the traverse-sliding or thrust-rolling stand by the control of the reduction per pass on a 4-high roll stand arranged ahead and/or after the traverse-sliding or thrust-rolling stand.

A further object of the present invention is the provision of apparatus for execution of the above rolling method.

With these and other objects in view, as will be apparent to those skilled in the art, the invention resides in the combination of parts set forth in the specification and covered by the claims appended hereto.

SUMMARY OF THE INVENTION

According to this invention, a pre-determined circumferential speed differential ratio is maintained between the individual rolls of the traverse-sliding or thrust-rolling stand by mechanical and/or electrical control combinations of the individual roll pair drives. One form of the invention comprises a gear set which is activated by a common drive and is coupled with the rolls of a roll pair. So that different rolling programs may be executed, this invention also provides that the circumferential speed differential ratio between the individual rolls of the traverse sliding or thrust-rolling stand is pre-determined by a cascade connection arrangement of the gears.

It is a further importance in this invention that the roll gap control of the 4-high roll stand or stands be activated by measurements of thickness of the rolling stock on the inlet and outlet side of the traverse-sliding or tension-rolling stands. In addition, according to this invention, the RPM of the drive for the traverse-sliding or shear-rolling stand is maintained at a constant value and the reduction per pass and/or the run-off speed of the forwardly-located 4-high roll stand is controlled and/or pre-adjusted. A further extension of this invention consists of making the rolls of each pair of combined rolls of different diameters to pre-determine a certain circumferential speed differential ratio between the rolls in each pair, whereas all other circumferential speed differential ratios are derived from the cascade connections of the gear drives.

By means of the procedures carried out in accordance with this invention, the remarkable advantage is that the pre-determined reduction is achieved at the start of the rolling mill operation.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
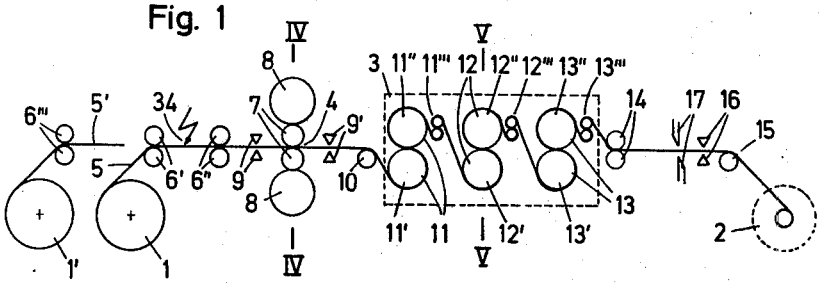
FIG. 1 is a schematic side view of a rolling mill embodying the principles of the present invention.

Referring to FIG. 1 of the drawing, there is shown a rolling mill for thickness reduction of metal strip material, having on the inlet side a drag reel 1 and on the exit side a pull reel 2. The rolling mills in the embodiments shown in FIGS. 1–3 consists of a so-called traverse-sliding, or thrust-rolling stand 3 and out at least 4-high one roll stand 4. In the rolling mill embodiment shown in FIG. 1, the 4-high roll stand 4 is arranged in front (on the inlet side) of the traverse-sliding, or thrust-rolling stand 3. In the embodiment shown in FIG. 2, the 4-high roll stand 4 is located at the exit side of the traverse-sliding or thrust-rolling stand 3.

Figure 2:
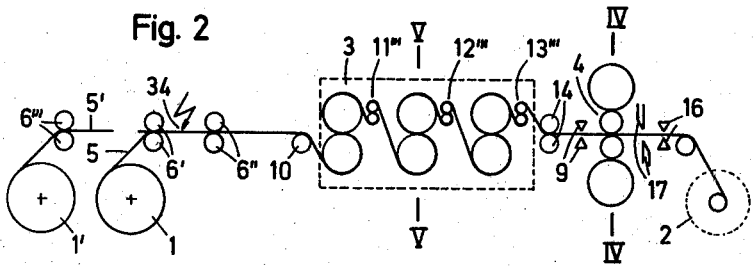
FIG. 2 is a view similar to FIG. 1, showing a first modification.
Figure 3:
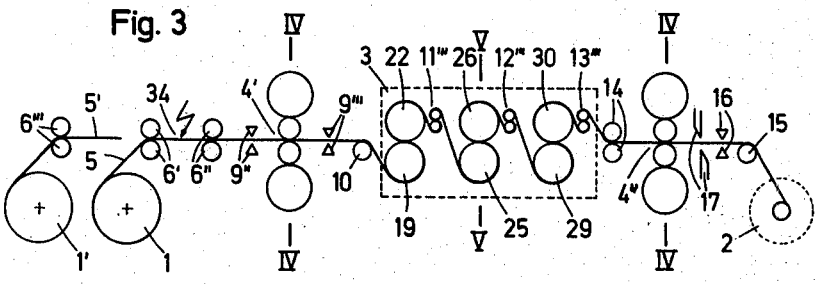
FIG. 3 is a view similar to FIG. 1, showing a third modification.

In the embodiment shown in FIG. 3, a 4-high roll 4′ is located in front of the inlet side an a further 4-high roll stand 4″ is located at the outlet side of the traverse-sliding or thrust-rolling stand 3. In each of the three rolling mills shown in FIGS. 1–3, the metal strip material 5 is pulled from the roll-off or drag reel 1 by drive apparatus 6′ and thereafter is introduced into the actual rolling mill by another drive apparatus 6″.

In the rolling mill of FIG. 1, the metal strip material 5 passes first through the roll gap between the two driven work rolls 7 of the 4-high roll stand 4, in which the rolls 7 are adjusted by means of the two support rollers 8 to provide a controlled rolling pressure against the metal strip material 5. According to FIG. 1, thickness measuring devices 9 and 9′ are provided on the inlet and outlet sides, respectively, of the 4-high roll stand 4. Measuring devices 9 and 9′ continuously measure the thickness of the material which enters and exits the quarto-stand 4. The metal strip 5 is then introduced into the thrust-rolling stand 3 through a guide roll 10. From there, the metal strip 5 passes tangentially onto the lower roll 11′ of a first combined roll pair 11, embraces a large part of its circumference and then enters the roll gap of the roll pair 11 tangentially to its upper roll 11″ and contacts a large part of its circumference.

From the upper roll 11″ of the first combined roll pair 11, the metal strip material 5 is transfered, for the purpose of stress relief, through a so-called S-roll pair 11‴ in a manner similar to the passage through the roll pair 11 and from there onto the lower roll 12′ of a second combined roll pair 12. The roll 12′ as well as the roll 12″ is surrounded in the same way as rollers 11′ and 11″ of the first combined roll pair 11 before it is exposed again for stress relief operation through an S-roll pair 12‴. It is then introduced into a third combined roll pair 13 formed by a lower roll 13′ and upper roll 13″.

The metal strip material 5 passes from the circumference of the upper roll 13″ of the third roll pair 13 for the purpose of further stress relief over a S-roll pair 13‴ towards the outlet side of the traverse sliding, or thrust-rolling stand 3. From there is passes over a guide pulley and drive roll 14 as well as a guide pulley 15 towards a roll-up or pull-reel 2. At the back of the outlet side of the thrust-rolling stand 3 is located a thickness measuring device 16 which continuously measures the thickness of the finished rolled metal strip material 5 and transfers the measurement back to the 4-high roll stand 4 for a combined thickness control. Cutting shears 17 are arranged at the outlet side of the thrust-rolling stand 3 and severs the metal strip material 5 according to demand.

The rolling mill embodiment shown in FIG. 2, consists basically of the same components as the rolling mill described in connection with FIG. 1. One difference, however, is that the 4-high roll stand 4 is not arranged ahead of the inlet side of the thrust-rolling stand 3, but a the outlet side thereof. A further difference in the rolling mill according to FIG. 2, compared to the one shown in FIG. 1, is that the thickness measuring device 9 is arranged between the outlet side of the thrust-rolling stand 3 and the inlet side of the 4-high roll stand 4, and the thickness measuring device 16, as well as the cutting shears 17, is arranged at the outlet side of the 4-high roll stand 4.

The embodiment shown in FIG. 3 consists of yet another design. In this case, a 4-high roll stand 4′ is arranged ahead of the inlet side of the thrust-rolling stand 3 and another 4-high roll stand 4″ is arranged at the back, that is to say, at the outlet side of the thrust-rolling stand 3. Thickness measuring devices 9″ and 9‴ are arranged on the inlet and outlet sides, respectively, of the 4-high roll stand 4′. A thickness-measuring device 16 is also arranged at the outlet side of the 4-high roll stand 4″.

An important criterion of the rolling mills built in accordance with FIGS. 1–3 is that the thrust-rolling stand 3 is operated completely without thickness control, that is to say, each of the three combined work roll pairs 11, 12, and 13 is operated with a constant reduction per pass, determined by the corresponding rolling program. The percentage-wise reduction per pass is not controlled by a corresponding adjustment of the roller gap, but is operated in such a way that the rolls 11″, 12″, and 13″ of the combined operating roll pairs 11, 12, and 13 receive a correspondingly larger circumferential speed for the percentage-wise reduction per pass than the rolls 11′, 12′, and 13′ of the individual roll pairs 11, 12, and 13. However, in cases where the thrust-rolling stand 3 (as shown in FIGS. 1–3), has several roll pairs 11, 12, and 13 arranged consecutively in the rolling direction, the circumferential speed of the roll 12′ of the second roll pair 12 has the same circumferential speed as the roll 11″ of the first roll pair 11. On the other hand, the circumferential speed of roll 13′ of the third roll pair 13 has the same circumferential speed as the roll 12″ of the second roll pair 12. This condition can be achieved by a mechanical and/or electrical combination of the individual roll pair drives.

In cases where each roll pair 11, 12, and 13 is equipped with its own drive, the combined adjustment of the circumferential speed for the rolls of the consecutively-arranged roll pairs 11, 12, and 13 is most simply accomplished by an electrical combination of the consecutive drives, whereby the electrical combination circuits which is used for the corresponding circumferential speed differential ratio between the two rolls of the previous roll pair should be considered. Electrical combination circuits are employed as a part of the process-calculator connected to the rolling mill. To guarantee a safe and problem-free operation of the thrust-rolling stand 3, all its roll pairs 11, 12, and 13 are driven by one common electrical motor 18, as can be seen from FIGS. 5 and 6. This drive motor 18 is connected directly with a shaft 19, which drive the roll 11' of the first roll set 11. On this shaft 19 and locked against turning are mounted three gear wheels 20', 20'', and 20''' for selective engagement with a corresponding number of gear wheels 21', 22'', and 21''', respectively, which are displacably-mounted on the shaft 22, which forms the drive for the upper roll 11'' of the roll set 11. The wheels 20', 20'', and 20''', therefore, form with the wheels 21', 21'', and 21''' a variable shift arrangement, so that the circumferential speed of the upper roll 11 of roll set 11'' may be varied relative to the circumferential speed of the lower roll 11' of the same roll set.

Tightly locked on the drive shaft for the upper roll 11'' is a gear wheel 23, which is continuously engaged with a wheel 24 through an intermediate gear element (not shown), and is locked to a shaft 25 which drives the lower roll 12' of the second roll set 12. Also locked on the shaft 25 are three gear wheels 20', 20'', and 20''' to which are arranged a corresponding number of displacement wheels 21', 21'', and 21''' which are adjustable on the driving shaft for the roll 12'' of the second roll set 12 in such a way that they are coupled for alternative selection with the wheels 20', 20'', and 20''', respectively, of shaft 25 and therefore form a second variable gear shift mechanism.

Also mounted on the drive shaft for the roll 12'', for rotation therewith, is an intermediate gear wheel (not shown) which is continuously engaged with a gear wheel 28 which is mounted for rotation with the drive shaft 29 for the roll 13' of the third roll set 13. Three gear wheels 20', 20'' and 20''' are selectively engaged with displacable gear wheels 21', 21'', and 21''', respectively, mounted on the drive shaft for the roll 13'' of the third roll set 13, thereby forming a variable gear shift mechanism between the rolls 13' and 13''.

Figure 5:
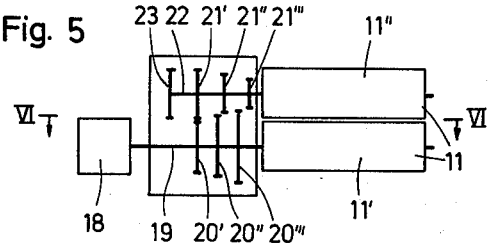
FIG. 5 is a schematic view of the rolling mill in the area of the traverse-sliding or thrust-rolling stand viewed at a right angle to the plane in FIG. 1.
Figure 6:
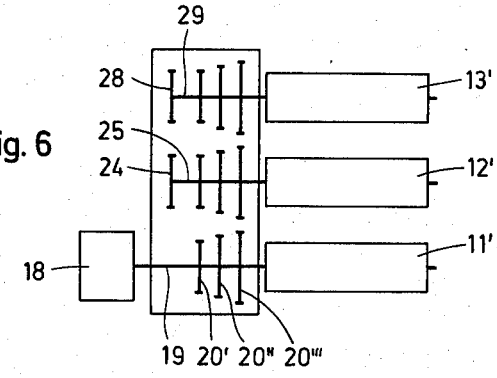
FIG. 6 is a schematic sectional view of the traverse-sliding or thrust-rolling stand taken along line VI—VI of FIG. 5, looking in the direction of the arrows.

The traverse-sliding or thrust-rolling stand 3, equipped with the drive arrangement shown in FIGS. 5 and 6, may be operated by only one drive motor 18 and a number of different rolling programs with variable reduction per pass and without any thickness control within the thrust-rolling stand 3. The extent of the corresponding reduction per pass within the roll gaps of the combined working roll pairs 11, 12, and 13 is activated exclusively by the individual variable gear shift mechanism by variations of the circumferential speeds of the upper rolls 11'', 12'', and 13'' relative to the lower rolls 11', 12', and 13'. The thickness tolerance will be automatically reduced percentage-wise for the corresponding percentage-wise reduction per pass.

When a separate drive motor 18 is used for each of the three roll pairs 11, 12, and 13, as mentioned above, the corresponding gear members which mechanically connect the roll sets are eliminated. In place of these mechanical gear members, electrical combination circuits, as mentioned above, are arranged which connect the different drives 18 with each other. The control of the final thickness for the metal strip material 5 is brought about in every case for all rolling mills shown in FIGS. 1–3 outside the thrust-rolling stand 3, and with the help of the pre- and/or post-arranged 4-high roll stands 4, 4', and 4''.

To initiate the control of the final thickness of the metal strip material 5, the thickness measurement is made on the inlet side and the outlet side of the 4-high roll stands 4. In the embodiments shown in FIG. 1, the inlet side measurement is made by the thickness measuring devices 9 and 9' and thickness measurement on the outlet side of the thrust-rolling stand 3 is made by the thickness measuring device 16. The thickness measuring device 16 signals any deviation from a pre-determined end-thickness to the process calculator or the like in which the determined intermediate thicknesses are stored which are to be created on the metal strip material 5 within the thrust-rolling stand 3. Depending on the amount of this deviation, the process calculator then controls the adjusting device 31 for the support rolls 8 of the 4-high roll stand 4, which brings about a corresponding roll gap change between the work rolls 7.

Under exceptional circumstances, it would be possible to change, by means of an infinitely variable speed drive, the differential ratio of the circumferential speed between the roll 13' and 13'' of the last roll pair 13 within the thrust-rolling stand, by a differential gear by means of the process calculator to achieve the pre-determined end-thickness of the metal strip material 5.

Figure 4:
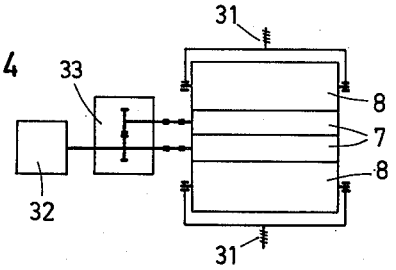
FIG. 4 is a schematic view of the 4-high stand viewed at a right angle to the plane IV—IV in FIG. 1.

Both work rolls 7 of the 4-high roll stand 4 are driven by a so-called twin-drive or as shown in FIG. 4, by a common drive motor 32 and a pinion roll stand 33. The thickness-measuring device 9 determines the change in thickness of the entering metal strip material 5 and so serves as a pre-control. The thickness-measuring device 9' determines the thickness change of the metal strip material 5 resulting from the roll gap change in the 4-high roll stand 4 before it enters the thrust-rolling stand and activates the post-control of the thickness. It thereby serves as a monitor for AGC-control (automatic gage control) within the roll gap of the 4-high roll stand 4. A correction of the drive speed for the motor 32 is achieved through a stress-measuring device at the guide pulley 10 between the 4-high roll stand 4 and the thrust-rolling stand 3, so that the circumferential speeds of the roll sets 11, 12, and 13 of the thrust-rolling stand 3 can be held constant to their pre-determined circumferential speed differential ratios.

The method of operation of the rolling mill shown in FIG. 2 corresponds generally with the operation of the one shown in FIG. 1. One difference, however, is that, in order to control the thickness of the metal strip material 5, the 4-high roll stand 4 is arranged at the rear of the outlet side of the thrust-rolling stand 3. The thickness-measuring device 16 passes a signal of any difference from the pre-determined wall thickness to a process calculator which releases a roll gap correction to the work rolls 7 of the 4-high roll stand 4 by a corresponding operation of the adjusting device 31. Based on this process calculator, the thickness-measuring device 9 also operates ahead of the inlet side of the 4-high roll stand 4, wherein thickness changes in the metal strip material 5 coming from the thrust-rolling stand 3 are determined to release a proportionate roll gap change. In this case, the process calculator does not have to show program components which are dependent on the adjusted intermediate thickness within thrust-rolling stand 3.

The embodiment shown in FIG. 3 of the drawing represents an especially advantageous operating rolling mill, but which requires a higher expenditure. It provides especially good operating results and, therefore, can be used for the rolling of quality metal strip material 5. The good operating result is achieved by the fact that a thickness control provided on the metal strip material 5 by the 4-high roll stand 4' is made before it enters the traverse-sliding or thrust-rolling stand 3, which control may be initiated by the thickness-measuring devices 9'' and 9''' through the process calculator. After the exit of the metal strip material 5 from the thrust-rolling stand 3 and the 4-high roll stand 4'', the thickness-measuring device 16 determines the thickness present in the strip. The measuring device 16 makes after-corrections through the process calculator to the pre-arranged 4-high roll stand 4' and introduces, in case it is necessary, a required after-control to the 4-high roll stand 4'' to achieve the final thickness of the metal strip material 5.

Figure 7:
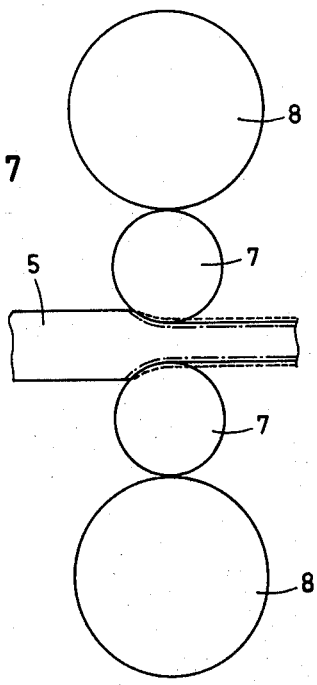
FIG. 7 is a schematic side view on an enlarged scale of the 4-high roll stand shown in FIG. 1 having a controllable roll-gap.
Figure 8:
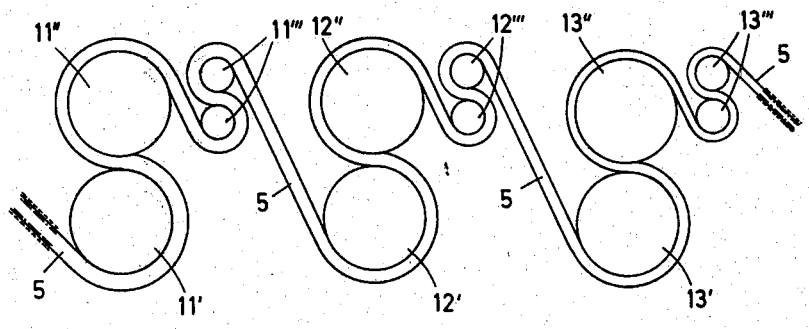
FIG. 8 is a schematic side view on an enlarged scale of the traverse-sliding or thrust-rolling stand, shown in FIG. 1.

FIG. 7 shows, in enlarged scale, the 4-high roll stand 4 used according to FIG. 1. FIG. 8 shows, in enlarged scale, the thrust-rolling stand 3 used according to FIG. 1. On the left side of FIG. 7 is indicated the exit thickness of the metal strip material 5. The right side of FIG. 7 shows, in solid lines, the rated size of the metal strip material 5 which has to be present when the indicated end-thickness of this metal strip material 5 is exactly kept (also shown on the right hand side of FIG. 8 by solid lines).

Indicated by dash-point lines in the FIGS. 7 and 8, are negative deviations from the rate sizes of the material thickness, which deviations must be corrected by a positive after-control of the roll gap within the 4-high stand 4 according to FIG. 7. The dash-lines, however, indicate positive deviations from the rated sizes and for its elimination and a roll gap after-control within the 4-high stand 4 is required in the negative sense. FIG. 8 indicates, in addition, the consecutive roll pairs 11, 12, and 13 of the thrust-rolling stand 3 with the S-roll pairs 11''', 12''', and 13''' arranged after them, which introduce during a rolling operation, a stress relief within the metal strip material 5.

The following table shows eight different rolling programs which, for example, may be executed with the rolling mill according to FIG. 1. It is assumed that the 4-high roll stand 4 is laid out for a control range which permits a thickness reduction between 10 and 40 percent. It is also assumed that the circumferential speed-differential ratio for the roll pair 11 of the thrust-rolling stand 3 may be pre-adjusted over the added variable speed control gear for thickness reduction of 10 percent, 30 percent, and 50 percent. The second roll pair 12 of the roll stand 3 permits 10, 20, and 40 percent thickness reductions over its variable speed control gear. For the roll pair 13 it is possible to achieve a thickness reduction of 10 and 30 percent through its variable speed control gear.

In column 1 of the table the different rolling programs are determined by identification numbers. Column 2 shows which strip thickness reduction is achieved. Column 3 shows the effective strip thickness reduction for which the 4-high stand 4 is selectively adjusted before the start of the corresponding rolling operation. Column 4 shows, percentage-wise, the selected reduction steps of the three roll pairs 11, 12, and 13 for the operation of the thrust-rolling stand 3. Finally, column 5 of the table shows the individual total thickness reduction in percent for the individual rolling program.

TABLE

| 1 | 2 | 3 | 4 | | | 5 |
|---|---|---|---|---|---|---|
| | | | Thrust-rolling stand (3) | | | |
| Rolling Operation | Strip Thickness Reduction | Quarto-Rolling Stand (4) | Rolling Pair (11) | Rolling Pair (12) | Rolling Pair (13) | Total Reduction |
| 1 | 5.0–3.0 | 4.12 | 10% | 10% | 10% | 40% |
| 2 | 4.0–2.0 | 3.51 | 30% | 10% | 10% | 50% |
| 3 | 2.5–1.0 | 2.0 | 30% | 20% | 10% | 60% |
| 4 | 2.0–0.6 | 1.58 | 30% | 40% | 10% | 70% |
| 5 | 2.0–0.45 | 1.66 | 50% | 40% | 10% | 77,5% |
| 6 | 2.0–0.36 | 1.70 | 50% | 40% | 30% | 82% |
| 7 | 2.0–0.30 | 1.44 | 50% | 40% | 30% | 85% |
| 8 | 2.0–0.26 | 1.25 | 50% | 40% | 30% | 87% |

From this table it is clear that for each of the eight listed rolling operations, a wall thickness control has to occur exclusively within the area of the 4-high roll stand 4 to achieve the desired final thickness of the strip material 5. This is due to the fact that the 3 roll pairs 11, 12, and 13 of the traverse-sliding or thrust-rolling stand 3 operate in every case through the variable speed gears, with fixed pre-adjusted circumferential speed-differential ratios, which naturally are selected in dependence on the outlet speed of the 4-high roll stand through the process calculator.

It may be mentioned here that certain circumferential speed-differential ratios between the two rolls of each roll pair 11, 12, and 13 of the traverse-sliding or thrust rolling stand 3 may be achieved by the use of different rolling barrel diameters if it is required to reduce the design expenditures for the individual variable speed gears. This offers the possibility of achieving a circumferential speed-differential ratio of 10% for each of the 3 roll pairs 11, 12, and 13 of the traverse-sliding or thrust rolling stand 3.

If, for example, the lower rolls 11', 12', and 13' of the three roll pairs 11, 12, 13, respectively, have a barrel diameter of 400 mm, then the complimenting upper rolls 11'', 12'', and 13'', respectively, have to be designed for a barrel diameter of 440 mm to achieve the corresponding revolutions per minute of the circumferential speed-differential ratio of 10%.

In the above design, the first gears 20', 21' may be eliminated for each of the three variable speed gears. During lay-out of the two remaining gears, the fixed circumferential speed-differential ratio has to be correspondingly considered.

So that a continuous rolling of strip material may be executed, an additional reel 1' is added to the initial reel 1 shown in FIGS. 1 to 3, so that the strip material 5' may be pulled off over a drive apparatus 6'''.

The strip starting end of the strip material 5' may be welded, with the help of a welding device 34, to the end of the strip material 5, for example, during a short interruption of the rolling operation of the whole rolling mill. Since no thickness control is made on thrust rolling stand 3, the rigid drive permits, after execution of the welding procedure, a start-up from zero speed with constant thickness reduction.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Method of rolling a metal strip in a rolling mill having a 4-high roll stand with an adjustable roll gap and a thrust-rolling stand, comprising at least one pair of combined rolls, said method comprising the steps of:
   (a) advancing the strip through the roll gap in the 4-high roll stand and the pair of combined rolls in the thrust-rolling stand so that the strip extends around the outside of one roll, between the pair of rolls and around the outside of the other roll, wherein the strip partially surrounds each roll of the pair,
   (b) rotating the rolls of the pair of combined rolls in opposite directions, and
   (c) maintaining a pre-determined circumferential speed differential ratio between the individual rolls of the pair of combined rolls for achieving a fixed percentage thickness reduction of the strip by the pair of rolls, and
   (d) reducing the strip as it passes through the 4-high roll stand to a predetermined thickness.

2. Method of rolling a metal strip as recited in claim 1, wherein the strip is advanced first through the 4-high roll stand and then through the thrust-rolling stand.

3. Method of rolling a metal strip as recited in claim 2, wherein the thickness of the strip is measured before and after the 4-high roll stand and after the thrust-rolling stand, and the roll gap of said 4-high roll stand is adjusted in accordance with said measurements.

4. Method of rolling a metal strip as recited in claim 1, wherein the strip advanced first through the thrust-rolling stand and then through the 4-high roll stand.

5. Method of rolling a metal strip as recited in claim 4, wherein the thickness of the strip is measured before and after the 4-high roll stand and the roll gap of said stand is adjusted in accordance with said measurements.

6. Method of rolling a metal strip as recited in claim 1, wherein the strip is advanced first through the 4-high roll stand, through the thrust-rolling stand and then through a second 4-high roll stand identical to the first 4-high roll stand.

7. Method of rolling a metal strip as recited in claim 6, wherein the thickness of the metal strip is measured before and after the first 4-high roll stand and after the second 4-high roll stand and the roll gap of said 4-high roll stands are adjusted in accordance with said measurements.

8. A rolling mill for rolling metal strips, comprising:
   (a) a 4-high roll stand with an adjustable roll gap for reducing the strip as it passes through the 4-high roll stand to a predetermined thickness,
   (b) a thrust-rolling stand in line with the 4-high roll stand and having at least one pair of combined rolls,
   (c) means for rotating the rolls of said pair of combined rolls in opposite directions, and
   (d) control means for maintaining a pre-determined circumferential speed differential ratio between the individual rolls of said pair of combined rolls for achieving a fixed percentage thickness reduction of the strip by said pair of rolls.

9. Rolling mill as recited in claim 8, wherein the control means comprises:
   (a) a common drive shaft,
   (b) an individual drive shaft connected to each roll of the thrust rolling stand, and
   (c) a multi-gear transmission for connecting each of the individual drive shafts to the common drive.

10. Rolling mill as recited in claim 9, wherein there is a plurality of pairs of combined rolls in the thrust rolling stand and the transmission comprises a plurality of selectable gear ratios for each pair of combined rolls.

11. Rolling mill as recited in claim 8, wherein said control means comprises that the rolls of the pair of combined rolls have different diameters.

12. Rolling mill as recited in claim 8, wherein the 4-high roll stand is located ahead of the thrust-rolling stand and said rolling mill comprises means for measuring the strip thickness located before and after the 4-high roll stand and after the thrust-rolling mill.

13. Rolling mill as recited in claim 8, wherein the 4-high roll stand is located after the thrust-rolling stand and said rolling mill comprises means for measuring the strip thickness before and after the 4-high roll stand.

14. Rolling mill as recited in claim 9, wherein the thrust-rolling stand is located between two 4-high roll stands and said rolling mill comprises means for measuring the strip thickness before and after the 4-high roll stand located ahead of the thrust-rolling stand, and after the 4-high roll stand located after the thrust-rolling stand.

* * * * *